United States Patent [19]

Wisner

[11] Patent Number: 4,800,368

[45] Date of Patent: Jan. 24, 1989

[54] PYROELECTRIC DETECTOR ARRANGEMENT

[75] Inventor: George R. Wisner, Deep River, Conn.

[73] Assignee: Otis Elevator Company, Farmington, Conn.

[21] Appl. No.: 91,796

[22] Filed: Sep. 1, 1987

[51] Int. Cl.[4] ..... G08B 13/18

[52] U.S. Cl. ..... 340/567; 250/353; 340/661

[58] Field of Search ..... 340/567, 573, 600, 825.49, 340/660–663; 187/130–132, 140; 250/342, 353, 349

[56] References Cited

U.S. PATENT DOCUMENTS

| | | | |
|---|---|---|---|
| 3,207,266 | 9/1965 | Hornung | 187/131 |
| 3,972,021 | 7/1976 | Leitz et al. | 187/132 X |
| 4,263,585 | 4/1981 | Schaefer | 340/567 |
| 4,346,427 | 8/1982 | Blissett et al. | 340/600 X |
| 4,431,918 | 2/1984 | White | 250/349 X |
| 4,510,488 | 4/1985 | St. Jean et al. | 340/567 |
| 4,734,585 | 3/1988 | Owers | 250/353 |

FOREIGN PATENT DOCUMENTS

| | | | |
|---|---|---|---|
| 1551541 | 8/1979 | United Kingdom | 250/342 |

*Primary Examiner*—Glen R. Swann, III

*Assistant Examiner*—Thomas J. Mullen, Jr.

*Attorney, Agent, or Firm*—Peter R. Ruzek

[57] ABSTRACT

An arrangement for detecting the passage of living beings into and out of a surveillance region includes optics which concentrate thermal radiation energy from the surveillance region into a detection zone where an active area of a pyroelectric detector is situated and converts the thermal radiation energy received thereby into an electrical signal. An evaluating device evaluates the electrical signal of the detector to provide an indication of either the entry of a living being from the outside into, or the exit of a person from, the surveillance region from a change in the total thermal radiation energy received by the active area from the surveillance region. The optics may incorporate a mask which prevents thermal radiation from the outside of the surveillance region from reaching the active area of the detector. The mask includes a marginal portion which peripherally bounds an opening for the passage of the thermal radiation energy from the surveillance region to the detection zone and which may include at least one serration at the opening for controlling the timing of the electrical signal caused by entry of a living being into an area of the surveillance region corresponding to the serration relative to those caused by entry of a living being into the remainder of the surveillance region.

9 Claims, 1 Drawing Sheet

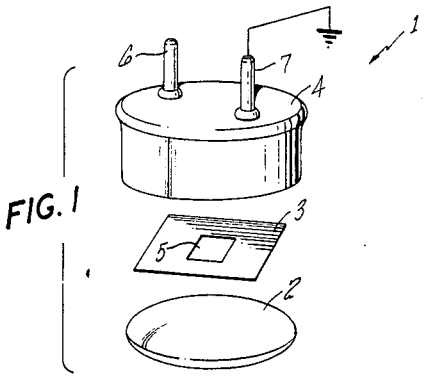
FIG. 1
FIG. 2
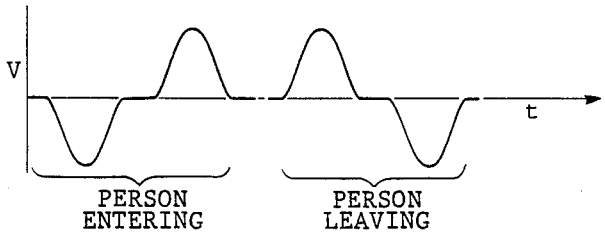
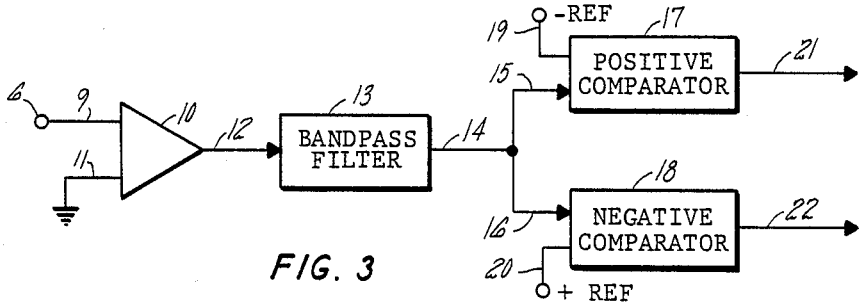
FIG. 3
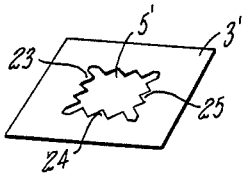
FIG. 4

PYROELECTRIC DETECTOR ARRANGEMENT

DESCRIPTION

1. Technical Field

The present invention relates to detecting equipment in general, and more particularly to a detecting arrangement capable of monitoring a predetermined region, such as an elevator floor landing region, for entry and exit of humans.

2. Background Art

There are already known various arrangements for detecting penetration of humans into and/or their movement in a controlled region. Such detecting arrangements are being used, for instance, to defend a perimeter of an installation, to monitor movement of personnel within an installation, to detect the presence of people on premises or the like. Detecting or sensing equipment of different types has been used, more or less successfully, for the above and similar detecting purposes. So, for instance, U.S. Pat. No. 4,263,585 discloses an intrusion detection system in which a multi-segment mirror focuses thermal radiation emanating from a moving person onto a thermopile detector in such a manner that each mirror segment separately directs the radiation in succession to detector elements, whereby the direction of movement of such a person can be determined. Another control device responsive to infrared radiation is disclosed in U.S. Pat. No. 4,346,427, wherein an infrared sensor is being used to detect any movement of a person into or within the region under surveillance, and the output signal of this sensor is utilized for controlling the operation of lights, air conditioning or the like for the affected region. A control device of this type is also disclosed in the published international patent application No. PCT/US81/01769 (International Publication No. WO 82/02270). Moreover, a passive infrared occupancy detector of a similar type has been developed by Tishman Research Co. and United Technologies Corporation and is commercially available under the designation Infracon Model 628.

As advantageous as the above devices may be for the purposes for which they have been developed, they are not suited for determining the number of people present in the region under surveillance. Yet, in some instances, it would be desirable to possess this information so as to be able to use it for various purposes, such as in dispatching elevators to various floors of a building. However, until recently, no attempts have been made to utilize any known detecting equipment of the above kind for controlling the operation of elevators, in spite of the fact that the previously existing elevator dispatching techniques left much to be desired as far as their effectiveness and responsiveness were concerned, since elevator control systems employing such known dispatching techniques were being operated by and large on the basis of floor calls, albeit possibly taking into consideration some recurring traffic patterns, for instance, those ordinarily repeating themselves in the course of the day, or the instantaneous loading of the elevator as determined by sensing the total weight of the elevator occupants.

In any event, however, elevators have heretofore been dispatched to the various floors, as a rule, without any real-time information as to the actual traffic flow. More particularly, no attempts have been made in the performance of such customary elevator dispatching techniques to use or even to gather information concerning the number of people waiting at a landing, be it because it was not recognized that this information, while presenting less than a complete picture of the traffic flow to occur in that the destination floors of the people waiting for an elevator to arrive would still not be known, could nevertheless be used in controlling the operation of the elevator in a considerably more economical manner than that possible before, without unduly burdening the people waiting for the elevator to arrive or those already in the elevator, or because it was felt that it would be impossible to reliably collect this information or that the cost of gathering this information would outweigh any benefits derived therefrom, or for other reasons.

Quite recently, it was recognized that the above information could indeed be used to advantage in controlling the operation of elevators, and it was attempted to develop approaches to the gathering and use of such information. So, for instance, it was proposed to utilize passive infrared sensors for such applications. Yet, the heretofore proposed approaches left much to be desired, especially as far as the accuracy or veracity of the information gathered by such detecting equipment was concerned. So, for instance, it was proposed to strategically position doubled light barriers across the entrances to and exits from the region under surveillance, the idea being that a person entering the surveillance region will interrupt one light beam first and the other light beam second, while a person leaving the surveillance region will interrupt the other light beam first and the one light beam second. However, experience with this approach has shown that the obtained results are very unreliable since they can be rather easily adversely affected by two people simultaneously entering and leaving the surveillance region, by hand movements of the person entering or leaving the surveillance region, by a hand or an arm of a person holding the elevator door, or the like.

Accordingly, it is a general object of the present invention to avoid the disadvantages of the prior art.

More particularly, it is an object of the present invention to provide an arrangement for detecting entry of living beings into a surveillance region, which arrangement does not possess the disadvantages of the known arrangements of this kind.

It is yet another object of the present invention to develop the arrangement of the above type in such a manner as to be able to generate reliable information as to the number of people present in the surveillance region at any given time.

Still another object of the present invention is to design the above arrangement in such a manner as to be able to accurately individually record the entry of people into the surveillance area even if such people enter as a group.

A concomitant object of the present invention is so to construct the above arrangement as to be relatively simple in construction, inexpensive to manufacture, easy to install and use, and reliable in operation nevertheless.

DISCLOSURE THE INVENTION

In keeping with these objects and others which will become apparent hereafter, one feature of the present invention resides in an arrangement for detecting the passage of living beings at least into a surveillance region. According to the invention, this arrangement includes optical means for concentrating thermal radiation energy from the surveillance region into a detection zone; pyroelectric detector means having at least one active area situated at the detection zone and operative for converting the thermal radiation energy received thereby into an electrical signal; and means for evaluating the electrical signal of the detector means to provide an indication of at least the entry of a living being from the outside into the surveillance region from a change in the total amount of thermal radiation energy received by the active area from the surveillance region as reflected in the electrical signal. The voltage of the electrical signal generated by the pyroelectric detector means undergoes a temporary initial change in one sense in response to the entry of a living being into the surveillance region, and in the opposite sense on departure of a living being from the surveillance area. These changes in the voltage levels of the electrical signal are detected and recorded, especially in an up-and-down counter responsive to the detection of such voltage level changes, and the count stored in the counter may then be used to control the operating regime of an elevator or an elevator bank.

BRIEF DESCRIPTION OF THE DRAWING

The present invention will be described in more detail below with reference to the accompanying drawing, in which:

FIG. 1 is an exploded simplified perspective view of a pyroelectric detecting arrangement of the present invention;

FIG. 2 is a diagram representing the changes in an analog electrical signal generated in the detecting arrangement of FIG. 1 in response to entry of a person into a surveillance region and to departure of a person from the surveillance region;

FIG. 3 is a block diagram depicting an evaluation circuitry which may be used for evaluating the signals received from the detecting arrangement of FIG. 1; and FIG. 4 is a top plan view of a mask which may be used in the optical system of the detecting arrangement of FIG. 1.

BEST MODE FOR CARRYING OUT THE INVENTION

Referring now to the drawing in detail, and first to FIG. 1 thereof, it may be seen that the reference numeral 1 has been used therein to identify a pyroelectric detector arrangement of the present invention in its entirety. The pyroelectric detector arrangement 1 includes as its main components a lens 2, a mask 3, and a pyroelectric detector or sensor 4.

The lens 2 concentrates electromagnetic radiation from the region to be surveilled, especially that in the infrared range of the spectrum, onto the pyroelectric detector 4. The lens 2, together with a non-illustrated housing supporting the components 2, 3 and 4, also prevents convection heat from reaching the detector 4. It is advantageous when the lens 2 is made of, or is coated with, a material which prevents radiation outside the spectral range of interest from reaching the detector 4, so that such unwanted radiation will not adversely affect the accuracy of measurement of the detector 4. The lens 2 has a relatively short focal length so as to concentrate the radiation from the surveillance region within a relatively short distance onto an active area of the detector 4.

The mask 3, which is shown to be interposed between the lens 2 and the detector 4, but which may be situated instead at any other location, such as in front of the lens as considered in the direction of propagation of the radiation to be detected from the region under surveillance to the detector 4, or constitute a part of the lens 2 by being directly applied or connected thereto, determines the outer boundary of the region under surveillance by masking out radiation from outside the surveillance region. Obviously, the mask 3 is so situated relative to the components 2 and 4 of the arrangement 1 and has such properties that it permits the radiation of interest from all of the surveillance region to reach the active area of the detector 4, while simultaneously preventing all such radiation of interest and other radiation stemming from regions external to the surveillance region from propagating toward the active area of the detector 4. As shown in FIG. 1, the mask 3 may have a single, substantially centrally located, rectangular aperture 5 through which the radiation from the surveillance region passes on its way to the detector 4.

The detector 4 may be of any known type sensitive to changes in the amount of infrared radiation reaching the same, but preferably is of a pyroelectric type, such as that available from the Plessey Company under the designation 5L5215. This pyroelectric detector already incorporates a germanium filter window which prevents passage of the undesired radiation therethrough, so that it is not necessary for the lens 2 to perform this filtering function.

As shown at the left-hand portion of FIG. 2 of the drawing, the pyroelectric detector 4 of the above type generates an electrical signal which first has a negative excursion from its initial value, followed by return to the initial value, a positive excursion, and final return to the initial value when a person enters the surveillance region, adding thermal energy to the scene. On the other hand, when a person leaves the surveillance region, with attendant reduction in the total thermal energy emanating from the surveillance region, the electrical signal issued by the pyroelectric detector 4 first has a positive excursion from its initial value, followed by return to the initial value, a negative excursion, and final return to the initial value. Thus, the sequence in which the negative and positive excursions occur indicates whether a person has entered or left the surveillance region. The pyroelectric detector 4 differentiates (with respect to time) the total optical power striking its active area, with only changes in the level of the optical power producing an output. This, of course, presupposes that the combined effect of the emissivity and the temperature of the person adds energy to the scene, but it would be rare indeed that this condition would not be satisfied.

The thus modulated electrical signal then appears at one terminal 6 of the detector 4, while another terminal 7 of the detector 4 is connected to the ground. This modulated electrical signal is then evaluated by an evaluating circuitry, such as the evaluating circuit 8 illustrated in FIG. 3 of the drawing.

The terminal 6 of the detector 4 is connected to one input 9 of an amplifier 10 of a known construction, while another input 11 of the amplifier 10 is grounded. An amplified version of the above electrical signal appears at an output 12 of the amplifier 10 and is supplied to an input of a bandpass filter 13 of a known construction. However, it will be appreciated that, when the detector 4 already incorporates an amplifier, the amplifier 10 may be omitted and the terminal 6 of the detector 4 is then directly connected to the input of the bandpass filter 13. The bandpass filter 13 filters out undesired frequencies from the amplified electrical signal, presenting a filtered electrical signal at its output 14.

In the construction illustrated in FIG. 3 of the drawing, the filtered electrical signal is then supplied from the output 14 of the bandpass filter 13 to respective first inputs 15 and 16 of positive and negative comparators 17 and 18 which also have well-known constructions. These comparators 17 and 18 have respective second inputs 19 and 20. The second input 19 of the positive comparator 17 has a negative reference voltage −REF supplied thereto, whereas a positive reference voltage +REF is supplied to the second input 20 of the negative comparator 18. The comparators 17 and 18 compare the signals appearing at the respective inputs 15 and 19, or 16 and 20, thereof, and issue respective binary signals at their respective outputs 21 and 22, depending on the results of the respective comparisons.

It is currently preferred for the comparators 17 and 18 to be of such a type that the effective output voltage of the positive comparator 17 will abruptly change upon entry of person into the surveillance region during the initial negative excursion of the electrical output signal of the detector 4 when the input voltage surpasses the reference voltage −REF with attendant change in the binary value of the output signal of the positive comparator 17, to abruptly return to its initial binary value during the return of the electrical output signal of the detector 4 to zero upon crossing the reference voltage −REF in the opposite sense, to remain at such initial binary value during the positive excursion of the electrical output signal of the detector 4, and will remain at its initial binary value when a person leaves the surveillance region during the initial excursion of the electrical output signal of the detector 4 in the positive sense and thus away from the reference voltage −REF, to abruptly change its binary value during the subsequent negative excursion of the electrical output signal of the detector 4 on passage of this electrical output signal through the reference voltage −REF and to maintain this other binary value for so long as the electrical output signal of the detector 4 remains beyond the reference value −REF with subsequent return to the initial binary value. Thus, it may be seen that the output signal of the positive comparator 17 will change its binary value earlier when a person enters the surveillance region than when a person leaves the surveillance region, as measured from the commencement of the respective initial excursion in the electrical output signal of the detector 4.

On the other hand, the effective output voltage of the negative comparator 18 will abruptly change when a person leaves the surveillance region during the initial positive excursion of the electrical output signal of the detector 4 as the input voltage surpasses the reference voltage +REF with attendant change in the binary value of the output signal of the negative comparator 18, to abruptly return to its initial binary value during the return of the electrical output signal of the detector 4 to zero upon crossing the reference voltage +REF in the opposite sense, to remain at such initial binary value during the negative excursion of the electrical output signal of the detector 4, and will remain at its initial binary value when a person enters the surveillance region during the initial excursion of the electrical output signal of the detector 4 in the negative sense and thus away from the reference voltage +REF, to abruptly change its binary value during the subsequent positive excursion of the electrical output signal of the detector 4 on passage of this electrical output signal through the reference voltage +REF and to maintain this other binary value for so long as the electrical output signal of the detector 4 remains beyond the reference value +REF with subsequent return to the initial binary value. As a consequence, the output signal of the negative comparator 18 will change its binary value earlier when a person leaves the surveillance region than when a person enters the surveillance region, as measured from the commencement of the respective initial excursion in the electrical output signal of the detector 4.

Thus, it may be seen that the binary value of the output signal of each of the comparators 17 and 18 will change in response to any change of sufficient magnitude in the total thermal radiation energy reaching the detector 4, whether such thermal radiation energy change is due to a person's entering or to a person's leaving the surveillance region. However, the time relationship between the changed binary values of the output signals of the comparators 17 and 18 will be different. More particularly, when a person enters the surveillance region, the binary value of the positive comparator 17 will change in advance of that of the negative comparator 18 and, when a person leaves the surveillance region, the binary value of the negative comparator 18 will change in advance of that of the positive comparator 17. In other words, the changed binary output values of the comparators 17 and 18 will be in one lead/lag relationship when a person enters, and in the opposite lead/lag relationship when a person leaves, the surveillance region.

The outputs 21 and 22 of the comparators 17 and 18 lead to a processing circuitry which is not illustrated and which is constructed to provide a counting function based on the above-mentioned lead/lag relationships and may incorporate an up-counter and a separate down-counter of known constructions. This processing circuitry may be of any known construction capable of exploiting the instantaneous lead/lag relationship for incrementing the count of the up-counter only when the output signal of the comparator 17 changes its binary value in advance of that of the comparator 18, and for incrementing the count of the down-counter only when the output signal of the comparator 18 changes its binary value in advance of that of the comparator 17, so that the up-counter and the down-counter respectively separately count the number of entries into and exits from the surveillance region, and thus ideally the number of people who have entered and who have left the surveillance region. The counts of these counters may then be subtracted from one another, for instance in a computer which controls the dispatching of elevators, and the result can then be used for efficiently dispatching the elevators to the respective floors of the building in accordance with demand. The counts of such counters will then also provide information as to the total number of people who have passed through the respective surveillance area during a given period of time, and thus the number of people who have used the elevators to travel to and from the particular floor. However, it is also possible and contemplated by the present invention, especially when such total separate counts of people entering and leaving the surveillance region are not of interest, to construct the aforementioned processing circuitry in such a manner that the output signals appearing on the outputs 21 and 22 of the comparators 17 and 18 are respectively supplied to the up-counting and the down-counting inputs of a non-illustrated single up-and-down counter of a known construction, in which case the output signal of this single up-and-down counter will ideally directly provide the information about the number of people present at the respective landing at any particular time. In this case, the processing circuitry may be of the type disclosed in a commonly owned copending patent application Ser. No. 07/091,622, the disclosure of which is incorporated herein by reference.

It will be appreciated from the above explanation of the operation of the comparators 17 and 18 that it is immaterial for counting or detection purposes exactly how much a person entering or leaving the surveillance region adds to or subtracts from the total heat contents of the scene, so long as the amount of added or subtracted heat is sufficient to cause the effective voltage of the positive or negative comparator 17 or 18 surpass the respective reference or threshold voltage −REF or +REF and so long as the entry of a person adds to and the exit of a person subtracts from the total heat contents of the scene. Rather, this heat amount will only slightly influence the timing of the issuance of the changed binary signal of the comparator 17 or 18 but not the lead/lag relationship, except under extreme conditions which will hardly, if ever, be encountered. This has the advantage that the counting operation will not be adversely affected either by the size of, or the character of the outer garments worn by, the particular person entering or leaving the surveillance region, or, in most instances, the weather or heat conditions prevailing outside or within the surveillance region, all of which may influence the total heat output of the particular person.

However, for the same reason, this feature of the detecting arrangement 1 of the present invention has an undesirable consequence when the arrangement 1 is used in applications where a number of people can simultaneously enter and/or leave the surveillance region, in that the arrangement 1 as described so far is incapable of distinguishing between the entry (or exit) of a single person and of two or more people at the same time. To avoid this drawback, it is proposed in accordance with another aspect of the present invention to use a mask 3' shown in FIG. 4 of the drawing in the detecting arrangement 1 instead of the mask 3 illustrated in FIG. 1. The mask 3' has an opening 5' which is bounded by a serrated border 23 consisting of a plurality of individual projections 24 separated from each other by intervening spaces 25. The projections 24 (and hence the spaces 25) are shown to have triangular configurations, but it is contemplated as well to use projections 24 having other configurations, such as trapezoidal, rectangular, part-circular or other, as well as combinations of such configurations. The projections 24 may be provided only at areas of the border 23 corresponding to all or some of the entrances to or exits from the surveillance region, or all around the periphery of the aperture 5'.

The projections 24 prevent radiation from corresponding areas of the surveillance region from reaching the detector 4, so that entry of a person passing into the surveillance region through one of such shielded areas will be detected by the detector 4 at a later time than if that person entered through an unshielded area corresponding to the respective space 25 of the border 23. Thus, if two persons walk into the surveillance region abreast, the entry of one will be detected sooner than that of the other, and both will be counted. Conversely, on leaving the surveillance region, the exit of a person passing through the shielded area will be detected sooner than that of a person leaving through the unshielded area, and once more both of such persons will be counted. This principle can also be extended to three or more people entering or leaving simultaneously.

Despite the above-described precautions, it is still possible that the count provided by the counters or counter may be inaccurate. Therefore, in practical applications, it is desirable to provide a reset for the counters or counter to delete from time to time residual counts caused by inaccuracies of the detector 4 or of its operation. This housekeeping chore can be performed by the main controller or computer, for instance, by comparing call button activity for the respective floor with the counter output. So, for instance, the up-and-down counter could be reset to zero after a predetermined, relatively long period of call button inactivity. activity.

While the present invention has been illustrated and described as embodied in a particular construction of the detecting arrangement, it will be appreciated that the present invention is not limited to this particular example; rather, the scope of protection of the present invention is to be determined solely from the attached claims.

I claim:

1. An arrangement for detecting the passage of living beings at least into a surveillance region, comprising optical means for concentrating thermal radiation energy from the surveillance region into a detection zone;

pyroelectric detector means having at least one active area situated at said detection zone and operative for converting the thermal radiation energy received thereby into an electrical signal;

means for evaluating said electrical signal of said detector means to provide an indication of at least the entry of a living being from the outside into the surveillance region based on change in the total amount of the thermal radiation energy received by said active area from the surveillance region as reflected in said electrical signal; and means for controlling the timing of the electrical signal caused by entry of a living being into a selected portion of the surveillance region relative to those caused by entry of a living being into the remainder of the surveillance region, including masking means for preventing thermal radiation from the outside of the surveillance region from reaching said active area of said detector means, said masking means including a marginal portion which peripherally bounds an opening for the passage of the thermal radiation energy from the surveillance region to said detection zone and includes at least one serration at said opening for controlling the timing of the electrical signal caused by entry of a living being into a portion of the surveillance region corresponding to said serration relative to those caused by entry of a living being into the remainder of the surveillance region.

2. The arrangement as defined in claim 1, wherein said serration is a tooth.

3. The arrangement as defined in claim 1, wherein said serration is a notch.

4. An arrangement for detecting the passage of living beings at least into a surveillance region, comprising optical means for concentrating thermal radiation energy from the surveillance region into a detection zone;

pyroelectric detector means having at least one active area situated at said detection zone and operative for converting the thermal radiation energy received thereby into an electrical signal in such a manner that entry of a living being into the surveillance region results in a temporary initial change in the voltage of said electrical signal in a predetermined sense; and means for evaluating said electrical signal of said detector means to provide an indication of at least the entry of a living being from the outside into the surveillance region, based on a change in the total amount of the thermal radiation energy received by said active area from the surveillance region as reflected in said electrical signal, including said evaluating means means for detecting the occurrence of aid initial change in said electrical signal and generating an output signal indicative of such occurrence, and means for cumulatively storing said output signal.

5. The arrangement as defined in claim 4, wherein said optical means includes masking means for preventing thermal radiation from the outside of the surveillance region from reaching said active area of said detector means.

6. The arrangement as defined in claim 5, wherein said masking means includes a marginal portion which peripherally bounds an opening for the passage of the thermal radiation energy from the surveillance region to said detection zone.

7. The arrangement as defined in claim 4, and further comprising means for controlling the timing of the electrical signal caused by entry of a living being into a selected portion of the surveillance region relative to those caused by entry of a living being into the remainder of the surveillance region.

8. The arrangement as defined in claim 4, wherein said pyroelectric detector means is further operative for generating said electrical signal in such a manner that departure of a living being from the surveillance region results in a temporary initial change in the voltage of said electrical signal opposite to the predetermined sense; and wherein said evaluating means further includes means for detecting the occurrence of such opposite change in said electrical signal and generating an additional output signal indicative of such occurrence, and means for cumulatively storing said additional output signal.

9. The arrangement as defined in claim 4, wherein said cumulatively storing means includes a counter having an up-counting input connected to said detecting means and a down-counting input, said counter being operative for increasing its count in response to signals supplied to said up-counting input and reducing its count in response to signals supplied to said down-counting input thereof; wherein said pyroelectric detector means is further operative for generating said electrical signal in such a manner that departure of a living being from the surveillance region results in a temporary initial change in the voltage of said electrical signal opposite to the predetermined sense; and wherein said evaluating means further includes means for detecting the occurrence of such opposite change in said electrical signal and generating and presenting at an output thereof an additional output signal indicative of such occurrence, said output being connected to said down-counting input of said counter to supply said additional output signal thereto for reducing the count of said counter.

* * * * *

UNITED STATES PATENT AND TRADEMARK OFFICE

CERTIFICATE OF CORRECTION

PATENT NO. : 4,800,368

DATED : January 24, 1989

INVENTOR(S) : George R. Wisner

It is certified that error appears in the above-identified patent and that said Letters Patent is hereby corrected as shown below:

Column 9, Claim 4, Line 20 Delete "including"

Column 9, Claim 4, Line 21 After "means" insert

--including--

Signed and Sealed this

Ninth Day of June, 1992

*Attest:*

DOUGLAS B. COMER

*Attesting Officer*

*Acting Commissioner of Patents and Trademarks*